US008220541B2

(12) United States Patent
Martinez et al.

(10) Patent No.: US 8,220,541 B2
(45) Date of Patent: Jul. 17, 2012

(54) INTERVENTION TOOL WITH OPERATIONAL PARAMETER SENSORS

(75) Inventors: Ruben Martinez, Houston, TX (US); Matthew Billingham, Houston, TX (US); Todor Sheiretov, Houston, TX (US); Paul Beguin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/562,672

(22) Filed: Sep. 18, 2009

(65) Prior Publication Data

US 2010/0006279 A1 Jan. 14, 2010

Related U.S. Application Data

(63) Continuation of application No. 11/380,690, filed on Apr. 28, 2006, now Pat. No. 7,607,478.

(51) Int. Cl.
*E21B 47/01* (2006.01)

(52) U.S. Cl. ..... 166/250.01; 166/65.1

(58) Field of Classification Search ..... 166/66, 166/65.1, 250.01, 212
See application file for complete search history.

(56) References Cited

U.S. PATENT DOCUMENTS

| | | | | | |
|---|---|---|---|---|---|
| 3,661,205 | A | * | 5/1972 | Belorgey | 166/66.4 |
| 4,102,394 | A | * | 7/1978 | Botts | 166/66 |
| 5,033,549 | A | | 7/1991 | Champeaux | |
| 5,115,860 | A | | 5/1992 | Champeaux | |
| 5,224,547 | A | | 7/1993 | Burns | |
| 5,228,507 | A | | 7/1993 | Obrejanu | |
| 5,310,001 | A | | 5/1994 | Burns | |
| 5,322,118 | A | | 6/1994 | Terrell | |
| 5,392,715 | A | * | 2/1995 | Pelrine | 104/138.2 |
| 5,398,753 | A | | 3/1995 | Obrejanu | |
| 5,575,331 | A | | 11/1996 | Terrell | |
| 5,592,991 | A | | 1/1997 | Lembcke | |
| 5,636,689 | A | | 6/1997 | Rubbo | |
| 5,675,088 | A | * | 10/1997 | Serata | 73/784 |
| 5,778,980 | A | | 7/1998 | Comeau | |
| 5,947,213 | A | | 9/1999 | Angle | |
| 5,961,252 | A | * | 10/1999 | Mercer et al. | 405/175 |
| 6,029,744 | A | | 2/2000 | Baird | |
| 6,041,856 | A | * | 3/2000 | Thrasher et al. | 166/53 |
| 6,041,860 | A | | 3/2000 | Nazzal et al. | |
| 6,112,809 | A | * | 9/2000 | Angle | 166/66 |
| 6,158,529 | A | * | 12/2000 | Dorel | 175/61 |
| 6,179,066 | B1 | * | 1/2001 | Nasr et al. | 175/45 |
| 6,196,309 | B1 | | 3/2001 | Estilette | |
| 6,206,108 | B1 | * | 3/2001 | MacDonald et al. | 175/24 |
| 6,216,784 | B1 | * | 4/2001 | Harrell | 166/250.15 |
| 6,216,789 | B1 | * | 4/2001 | Lorsignol et al. | 166/355 |

(Continued)

FOREIGN PATENT DOCUMENTS

GB 2330598 4/1999

(Continued)

*Primary Examiner* — Daniel P Stephenson

(74) *Attorney, Agent, or Firm* — Michael L. Flynn; Jody Lynn DeStefanis; Charlotte Rutherford

(57) ABSTRACT

An intervention tool for use inside a wellbore is provided that includes an intervention module capable of performing an intervention operation downhole, and a drive electronics module in communication with the intervention module and configured to control the intervention module. The tool also includes one or more sensors which measure at least one operational parameter of the intervention operation during the intervention operation. The intervention operation is optimized based on the measured at least one operational parameter.

61 Claims, 2 Drawing Sheets

U.S. PATENT DOCUMENTS

| | | | | |
|---|---|---|---|---|
| 6,257,332 | B1 * | 7/2001 | Vidrine et al. | 166/250.15 |
| 6,281,489 | B1 * | 8/2001 | Tubel et al. | 250/227.14 |
| 6,868,901 | B2 | 3/2005 | Mason | |
| 6,868,906 | B1 * | 3/2005 | Vail et al. | 166/250.01 |
| 7,096,976 | B2 * | 8/2006 | Paluch et al. | 175/48 |
| 7,219,747 | B2 * | 5/2007 | Gleitman et al. | 175/40 |
| 7,246,662 | B2 * | 7/2007 | Jabusch et al. | 166/250.15 |
| 2003/0164240 | A1 | 9/2003 | Vinegar | |
| 2003/0234111 | A1 * | 12/2003 | Echols et al. | 166/382 |
| 2005/0115741 | A1 * | 6/2005 | Terry et al. | 175/61 |
| 2005/0145415 | A1 | 7/2005 | Doering | |
| 2005/0217350 | A1 * | 10/2005 | Jabusch et al. | 73/64.55 |
| 2005/0263281 | A1 * | 12/2005 | Lovell et al. | 166/255.1 |
| 2006/0254768 | A1 * | 11/2006 | De Jesus et al. | 166/255.1 |
| 2006/0272809 | A1 * | 12/2006 | Tubel et al. | 166/250.01 |
| 2010/0018703 | A1 * | 1/2010 | Lovell et al. | 166/255.2 |

FOREIGN PATENT DOCUMENTS

| | | | |
|---|---|---|---|
| RU | 2241109 | C2 | 7/2004 |
| WO | 9812418 | | 3/1998 |
| WO | 2004074630 | A1 | 9/2004 |

* cited by examiner

INTERVENTION TOOL WITH OPERATIONAL PARAMETER SENSORS

CROSS-REFERENCE TO RELATED APPLICATION

The present document is a continuation of prior U.S. patent application Ser. No. 11/380,690, filed on Apr. 28, 2006 now U.S. Pat. No. 7,607,478.

FIELD OF THE INVENTION

The present invention relates generally to a downhole intervention tool, and more particularly to such a tool having one or more sensors for measuring one or more operational parameters of an intervention operation.

BACKGROUND

The following descriptions and examples are not admitted to be prior art by virtue of their inclusion within this section.

A wide variety of downhole tools may be used within a wellbore in connection with producing hydrocarbons from oil and gas wells. Downhole tools such as frac plugs, bridge plugs, and packers, for example, may be used to seal a component against a casing along the wellbore wall or to isolate one pressure zone of formation from another. In addition, perforating guns may be used to create perforations through the casing and into the formation to produce hydrocarbons.

Often times, however, it is desirable to use a downhole tool to perform various intervention operations, which maintain and/or optimize the production of a well. Existing tools are used to perform a variety of intervention operations. However, these tools are not capable of monitoring operational parameters during an intervention operation. Instead, with previous intervention tools, a desired operational parameter is measured by a separate tool, which measures the desired operational parameter only after the intervention operation is completed. As such, an operator may not know if an intervention operation is successful or not until after the operation is complete.

Accordingly, a need exists for a downhole tool for performing an intervention operation, which includes one or more sensors for measuring operational parameters of the intervention operation.

SUMMARY

In one embodiment, the present invention is an intervention tool for use inside a wellbore that includes an intervention module capable of performing an intervention operation downhole, and a drive electronics module in communication with the intervention module and configured to control the intervention module. The tool also includes one or more sensors which measure at least one operational parameter of the intervention operation during the intervention operation. The intervention operation is optimized based on the measured at least one operational parameter.

In another embodiment, the present invention is a method for performing an intervention operation that includes providing an intervention tool having one or more sensors; deploying the intervention tool downhole to a desired location in a wellbore; operating the intervention tool to perform an intervention operation; measuring at least one operational parameter during the intervention operation by use of the one or more sensors; and optimizing the intervention operation based on the measured at least one operational parameter.

In yet another embodiment, the present invention is a method for performing an intervention operation that includes providing an intervention tool having one or more sensors; deploying the intervention tool downhole to a desired location in a wellbore; operating the intervention tool to perform an intervention operation; measuring at least one operational parameter during the intervention operation by use of the one or more sensors; and monitoring the progress of the intervention operation based on the measured at least one operational parameter.

The claimed subject matter is not limited to embodiments that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

Implementations of various technologies will hereafter be described with reference to the accompanying drawings. It should be understood, however, that the accompanying drawings illustrate only the various implementations described herein and are not meant to limit the scope of various technologies described herein.

DETAILED DESCRIPTION OF EMBODIMENTS OF THE INVENTION

Figure 1:
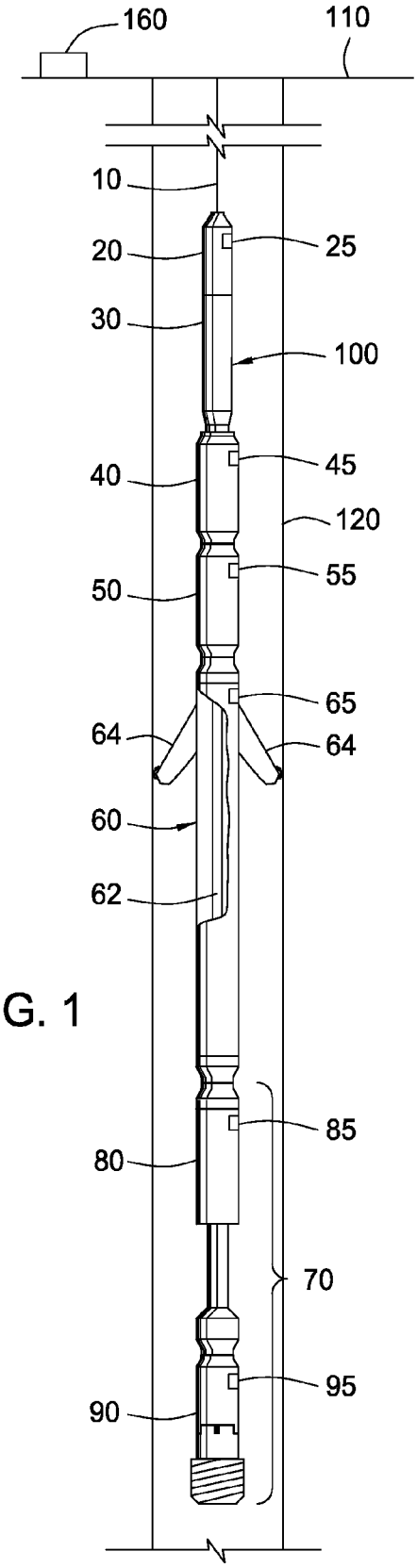
FIG. 1 is a schematic representation of an intervention tool for performing an intervention operation according to one embodiment of the present invention.
Figure 2:
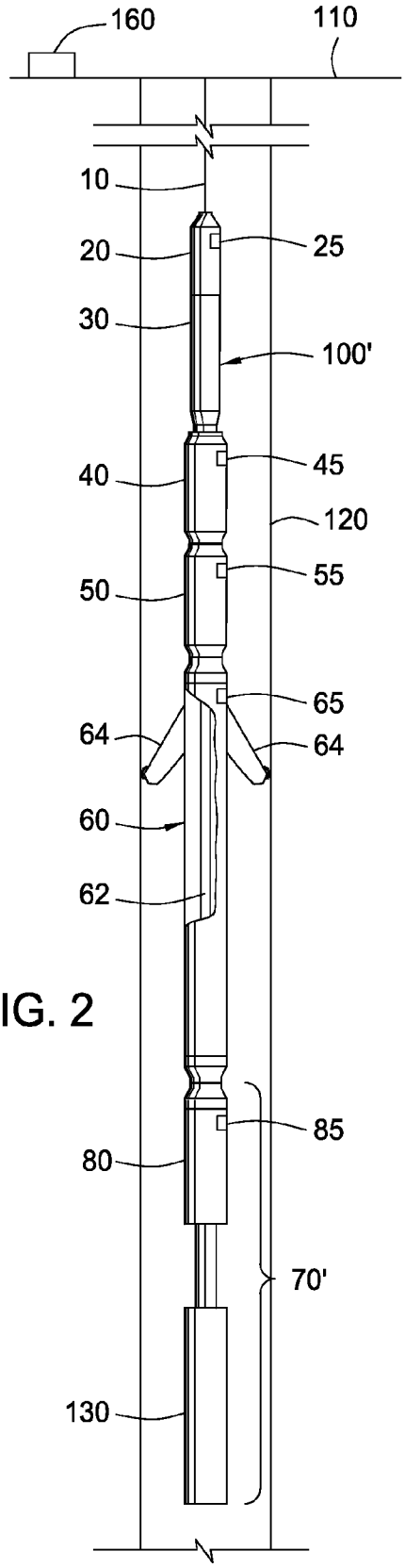
FIG. 2 is a schematic representation of an intervention tool for performing an intervention operation according to another embodiment of the present invention.
Figure 3:
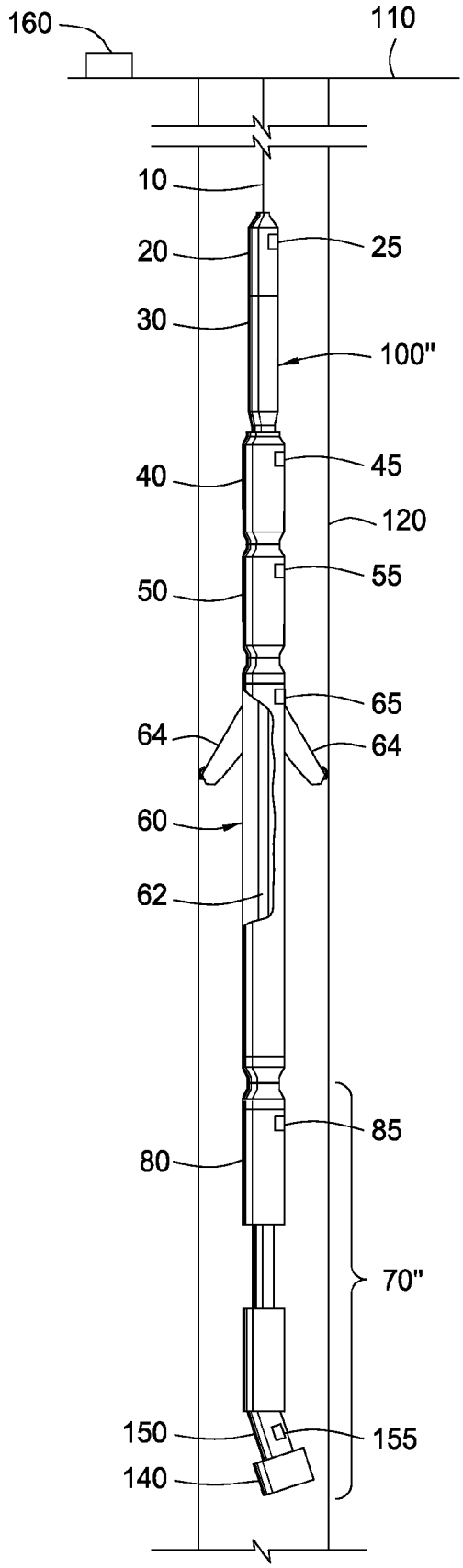
FIG. 3 is a schematic representation of an intervention tool for performing an intervention operation according to yet another embodiment of the present invention.

As shown in FIGS. 1-3, embodiments of the present invention are directed to an intervention tool for performing an intervention operation, which includes one or more sensors for measuring one or more operational parameters. In various embodiments of the invention, the operational parameters may be measured during an intervention operation. In addition, the measured operational parameters may be sent to a surface system at the surface during an intervention operation. In one embodiment, the intervention operation is optimized based on the measured operational parameters.

FIG. 1 is a schematic representation of an intervention tool 100 in accordance with one embodiment of the present invention. The intervention tool 100 may be configured to perform various intervention operations downhole, such as setting and retrieving plugs, opening and closing valves, cutting tubular elements, drilling through obstructions, performing cleaning and/or polishing operations, collecting debris, performing caliper runs, shifting sliding sleeves, performing milling operations, performing fishing operations, and other appropriate intervention operations. Some of these operations will be described in more detail in the paragraphs below.

In the embodiment of FIG. 1, the intervention tool 100 includes a head assembly 20, a communications module 30, a drive electronics module 40, a hydraulic power module 50, an anchoring system 60, and an intervention module 70, which may be defined as any device capable of performing an intervention operation.

The head assembly 20 may be configured to mechanically couple the intervention tool 100 to a wireline 10. In one embodiment, the head assembly 20 includes a sensor 25 for measuring the amount of cable tension between the wireline 10 and the head assembly 20. Although a wireline 10 is shown in FIG. 1, it should be understood that in other embodiments other deployment mechanisms may be used, such as a coiled tubing string, a slickline, or drilling pipe, among other appropriate deployment mechanisms.

The communications module 30 may be configured to receive and send commands and data which are transmitted in digital form on the wireline 10. This communication is used to initiate, control and monitor the intervention operation performed by the intervention tool. The communications module 30 may also be configured to facilitate this communication between the drive electronics module 40 and a surface system 160 at the well surface 110. Such communication will be described in more detail in the paragraphs below. As such, the communications module 30 may operate as a telemetry device.

The drive electronics module 40 may be configured to control the operation of the intervention module 70. The drive electronics module 40 may also be configured to control the hydraulic power module 50. As such, the drive electronics module 40 may include various electronic components (e.g., digital signal processors, power transistors, and the like) for controlling the operation of the intervention module 70 and/or the hydraulic power module 50.

In one embodiment, the drive electronics module 40 may include a sensor 45 for measuring the temperature of the electronics contained therein. In another embodiment, the drive electronics module 40 may be configured to automatically turn off or shut down the operation of the electronics if the measured temperature exceeds a predetermined maximum operating temperature.

The hydraulic power module 50 may be configured to supply hydraulic power to various components of the intervention tool 100, including the anchoring system 60 and the intervention module 70. The hydraulic power module 50 may include a motor, a pump and other components that are typically part of a hydraulic power system. In one embodiment, the hydraulic power module 50 includes one or more sensors 55 for measuring the amount of pressure generated by the hydraulic power module 50. In another embodiment, the one or more hydraulic power module sensors 55 are used to measure the temperature of the motor inside the hydraulic power module 50. The pressure and/or temperature measurements may then be forwarded to the drive electronics module 40.

In response to receiving the measurements from the one or more hydraulic power module sensors 55, the drive electronics module 40 may determine whether the measured temperature exceeds a predetermined maximum operating temperature. If it is determined that the measured temperature exceeds the predetermined maximum operating temperature, then the drive electronics module 40 may automatically shut down or turn off the motor inside the hydraulic power module 50 to avoid overheating. Likewise, the drive electronics module 40 may monitor the measured pressure and control the hydraulic power module 50 to maintain a desired output pressure.

Alternatively, the drive electronics module 40 may forward the pressure and/or temperature measurements made by the one or more hydraulic power module sensors 55 to the surface system 160 through the communications module 30. In response to receiving these measurements, an operator at the well surface 110 may monitor and/or optimize the operation of the hydraulic power module 50, e.g., by manually turning off the motor or the pump of the hydraulic power module 50. Although the intervention tool 100 is described with reference to a hydraulic power system, it should be understood that in some embodiments the intervention tool 100 may use other types of power distribution systems, such as an electric power supply, a fuel cell, or another appropriate power system.

The anchoring system 60 may be configured to anchor the intervention tool 100 to an inner surface of a wellbore wall 120, which may or may not include a casing, tubing, liner, or other tubular element. Alternatively, the anchoring system 60 may be used to anchor the intervention tool 100 to any other appropriate fixed structure or to any other device that the intervention tool 100 acts upon.

In one embodiment the anchoring system 60 includes a piston 62 which is coupled to a pair of arms 64 in a manner such that a linear movement of the piston 62 causes the arms 64 to extend radially outwardly toward the wellbore wall 120, thereby anchoring the intervention tool 100 to the wellbore wall 120. In one embodiment, the anchoring system 60 includes one or more sensors 65 for measuring the linear displacement of the piston 62, which may then be used to determine the extent to which the arms 64 have moved toward the wellbore wall 120, and therefore the radial opening of the wellbore. In another embodiment, the one or more anchoring system sensors 65 are used to measure the amount of pressure exerted by the arms 64 against the wellbore wall 120. In yet another embodiment, the one or more anchoring system sensors 65 are used to measure the slippage of the intervention tool 100 relative to the wellbore wall 120.

As with the measurements discussed above, the linear displacement, radial opening, pressure and/or slippage measurements made by the one or more anchoring system sensors 65 may be forwarded to the drive electronics module 40. In one embodiment, the drive electronics module 40 may forward those measurements to the surface system 160 through the communications module 30. Upon receipt of the measurements, the operator at the well surface 110 may then monitor, adjust and/or optimize the operation of the anchoring system 60.

In another embodiment, the drive electronics module 40 automatically adjusts or optimizes the operation of the anchoring system 60, such as by adjusting the linear displacement of the piston 62 so that the arms 64 may properly engage the wellbore wall 120 based on the linear displacement, radial opening, pressure and/or slippage measurements.

As briefly mentioned above, the intervention tool 100 includes an intervention module 70, which is capable of performing an intervention operation. In one embodiment, the intervention module 70 includes a linear actuator module 80 and a rotary module 90. The linear actuator module 80 may be configured to push or pull the rotary module 90.

In one embodiment, the linear actuator module 80 includes one or more sensors 85 for measuring the linear displacement of the linear actuator. In another embodiment, the one or more linear actuator sensors 85 are used to measure the amount of force exerted by the linear actuator module 80. As with other measurements discussed above, the linear displacement and/or force measurements made by the one or more linear actuator sensors 85 may be forwarded to the drive electronics module 40, which may then forward these measurements to the surface system 160 through the communications module 30. Upon receipt of the linear displacement and/or force measurements, the operator at the well surface 120 may monitor and/or optimize the operation of the linear actuator module 80.

In one embodiment, the drive electronics module 40 may automatically adjust the linear displacement of the linear actuator module 80 and the amount of force exerted by the linear actuator module 80 based on the linear displacement and/or force measurements made by the one or more linear actuator sensors 85.

The rotary module 90 may be configured to rotate any device or tool that may be attached thereto. In one embodiment, the rotary module 90 includes a sensor 95 for measuring the amount of torque exerted by the rotary module 90. In another embodiment, the one or more rotary module sensors 95 are used to measure the velocity (e.g., revolutions per minute (rpm)) of the rotary module 90. In yet another embodiment, the one or more rotary module sensors 95 are used to measure the temperature of the module 90. In still another embodiment, the one or more rotary module sensors 95 are used to measure the vibrations produced by the rotary module 90.

As with other measurements discussed above, the torque, velocity, temperature and/or vibration measurements made by the one or more rotary module sensors 95 may be forwarded to the drive electronics module 40, which may then forward those measurements to the surface system 160 through the communications module 30. Upon receipt of the torque, velocity, temperature and/or vibration measurements, the operator at the well surface 120 may monitor and/or optimize the operation of the rotary module 90. In one embodiment, the drive electronics module 40 may automatically optimize the operation of rotary module 90 based on the torque, velocity, temperature and/or vibration measurements.

In one embodiment, a tractor is disposed between the communications module 30 and the drive electronics module 40 to deploy the intervention tool 100 downhole. Once the intervention tool 100 has been set at a desired location in the wellbore 120, the tractor may be turned off. In this manner, the intervention tool 100 may be modular.

In FIG. 1, the intervention tool 100 includes a linear actuator module 80 coupled to a rotary module 90. FIG. 2 shows an intervention tool 100' having an intervention module 70', wherein the rotary module 90 is replaced with another intervention accessory 130. The intervention accessory 130 may be any accessory capable of performing an intervention operation. For example, exemplary intervention accessories 130 include a shifting tool used to engage a sliding feature in a completions device, a debris remover (e.g., a wire brush) or collector, a milling or drilling head, a hone, a fishing head, a welding tool, a forming tool, a fluid injection system, or any combination thereof among other appropriate accessories.

The shifting tool may be configured to open and close sliding sleeves, formation isolation valves, and other flow control devices used in well completions. The debris remover may be configured to dislodge cement, scale, and the like from the inside wall of the tubing. The debris collector may be configured to collect sand, perforating residue and other debris from the inside of the tubing or casing. The milling or drilling head may be configured to mill and drill downhole obstructions, e.g., plugs, scale bridges and the like. The hone may be configured to polish seal bores.

FIG. 3 shows an intervention tool 100" having an intervention module 70", wherein an intervention accessory 140 is attached to an articulated rotary shaft 150, which may be used to angle the accessory 140 away from the longitudinal axis of the tool 100". Such an articulated rotary shaft 150 facilitates some intervention operations such as milling windows or machining other features in a wellbore casing. In one embodiment, the articulated rotary shaft 150 includes one or more sensors 155 for measuring the angle of inclination of the rotary shaft, the angular orientation of the offset, and/or the side force applied by the articulated rotary shaft. The sensors 155 may additionally, or alternatively, be used for acquiring still or moving images of the operation being performed.

In this manner, while an intervention operation is being performed downhole, any of the various measurements described above regarding the intervention operation may be made and communicated within the intervention tool 100, 100', 100". Based on these measurements, the intervention tool 100, 100', 100" may automatically adjust the operating parameters of the various modules or accessories to which the measurements relate.

Alternatively, any of the various measurements described above regarding the intervention operation may be communicated to the surface system 160, which allows an operator to monitor the progress of the intervention operation and to optimize the intervention operation, if necessary. This optimization may be performed by the surface system 160 either automatically or manually. In one embodiment, any of the various measurements described above regarding the intervention operation may be communicated to the surface system 160 in real time. In another embodiment, any of the various measurements described above regarding the intervention operation may be recorded for later retrieval either in the intervention tool 100, 100', 100" or in the surface system 160.

Note that while the above embodiments of the intervention tool 100, 100', 100" are shown in a vertical well, the above described embodiments of the intervention tool 100, 100', 100" may be used in horizontal or deviated wells as well.

While the foregoing is directed to implementations of various technologies described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising:

an anchor assembly configured to anchor the apparatus at a position within a wellbore;

an intervention accessory selected from the group consisting of:

a linear-actuated intervention accessory; and a rotary-actuated intervention accessory;

an actuator configured to cause linear or rotary motion of the intervention accessory relative to the anchor assembly and the anchored position of the apparatus within the wellbore;

a downhole hydraulic power module configured to power the anchor assembly and/or the actuator and comprising a sensor configured to measure, during the motion of the intervention accessory caused by the actuator, at least one of:

an amount of pressure generated by the downhole hydraulic power module; and a temperature of the downhole hydraulic power module and/or one or more components of the downhole hydraulic power module; and a drive electronics module configured to:

control the actuator to cause the motion; and adjust control of the actuator during the motion based on the measured pressure and/or temperature.

2. The apparatus of claim 1 wherein the downhole hydraulic power module comprises a motor and a pump.

3. The apparatus of claim 1 wherein the drive electronics module is further configured to control the downhole hydraulic power module based on the measured pressure and/or temperature to maintain a desired operational parameter of the downhole hydraulic power module.

4. The apparatus of claim 1 wherein the drive electronics module is further configured to automatically terminate operation of the downhole hydraulic power module when the measured pressure and/or temperature exceeds a predetermined threshold.

5. The apparatus of claim 1 further comprising:

a head assembly coupled between the drive electronics module and a wireline conveyance assembly; and a communications module coupled to the head assembly and configured to cause transmission of the measured pressure and/or temperature to a surface system at the well surface via the head assembly and the wireline conveyance assembly.

6. The apparatus of claim 1 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

7. The apparatus of claim 1 wherein the intervention accessory is configured to interface with an object in the wellbore selected from the group consisting of: a plug; a packer; a valve; and a sliding sleeve.

8. An apparatus, comprising:

an anchor assembly configured to anchor the apparatus at a position within a wellbore, wherein the anchor assembly comprises:

a plurality of arms;

a piston operable to drive the arms into engagement with a wall of the wellbore; and a sensor;

an intervention accessory selected from the group consisting of:

a linear-actuated intervention accessory; and a rotary-actuated intervention accessory;

an actuator configured to cause linear or rotary motion of the intervention accessory relative to the anchor assembly and the anchored position of the apparatus within the wellbore, wherein the sensor is configured to measure, during the motion of the intervention accessory caused by the actuator, a parameter associated with the operation or motion of the anchor assembly; and a drive electronics module configured to:

control the actuator to cause the motion; and adjust control of the actuator during the motion based on the measured parameter.

9. The apparatus of claim 8 wherein the parameter is a linear displacement of the piston.

10. The apparatus of claim 8 wherein the parameter is a radial displacement of the arms.

11. The apparatus of claim 8 wherein the parameter is an amount of pressure exerted by the arms against the wall of the wellbore.

12. The apparatus of claim 8 wherein the parameter is an amount of slippage of the apparatus relative to the anchored position within the wellbore.

13. The apparatus of claim 8 further comprising:

a head assembly coupled between the drive electronics module and a wireline conveyance assembly; and a communications module coupled to the head assembly and configured to cause transmission of the measured parameter to a surface system at the well surface via the head assembly and the wireline conveyance assembly.

14. The apparatus of claim 8 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

15. The apparatus of claim 8 wherein the intervention accessory is configured to interface with an object in the wellbore selected from the group consisting of: a plug;

a packer; a valve; and a sliding sleeve.

16. An apparatus, comprising:

an anchor assembly configured to anchor the apparatus at a position within a wellbore;

a linear-actuated intervention accessory;

an actuator configured to cause linear motion of the intervention accessory relative to the anchor assembly and the anchored position of the apparatus within the wellbore;

a sensor configured to measure, during the motion of the intervention accessory caused by the actuator, an amount of linear force exerted by the actuator; and a drive electronics module configured to:

control the actuator to cause the motion; and adjust control of the actuator during the motion based on the measured amount of linear force.

17. The apparatus of claim 16 further comprising:

a head assembly coupled between the drive electronics module and a wireline conveyance assembly; and a communications module coupled to the head assembly and configured to cause transmission of the measured linear force to a surface system at the well surface via the head assembly and the wireline conveyance assembly.

18. The apparatus of claim 16 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

19. The apparatus of claim 16 wherein the intervention accessory is configured to interface with an object in the wellbore selected from the group consisting of: a plug; a packer; a valve; and a sliding sleeve.

20. An apparatus, comprising:

an anchor assembly configured to anchor the apparatus at a position within a wellbore;

a rotary-actuated intervention accessory;

an actuator configured to cause rotary motion of the intervention accessory relative to the anchor assembly and the anchored position of the apparatus within the wellbore;

a sensor configured to measure, during the motion of the intervention accessory caused by the actuator, an amount of torque exerted by the actuator; and a drive electronics module configured to:

control the actuator to cause the motion; and adjust control of the actuator during the motion based on the measured amount of torque.

21. The apparatus of claim 20 further comprising:

a head assembly coupled between the drive electronics module and a wireline conveyance assembly; and a communications module coupled to the head assembly and configured to cause transmission of the measured torque to a surface system at the well surface via the head assembly and the wireline conveyance assembly.

22. The apparatus of claim 20 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

23. The apparatus of claim 20 wherein the intervention accessory is configured to interface with an object in the wellbore selected from the group consisting of: a plug; a packer; a valve; and a sliding sleeve.

24. An apparatus, comprising:

an anchor assembly configured to anchor the apparatus at a position within a wellbore;

an intervention accessory selected from the group consisting of:

a linear-actuated intervention accessory; and a rotary-actuated intervention accessory;

an actuator configured to cause linear or rotary motion of the intervention accessory relative to the anchor assembly and the anchored position of the apparatus within the wellbore;

a sensor configured to measure, during the motion of the intervention accessory caused by the actuator, a velocity of the motion; and a drive electronics module configured to:

control the actuator to cause the motion; and adjust control of the actuator during the motion based on the measured velocity.

25. The apparatus of claim 24 further comprising:

a head assembly coupled between the drive electronics module and a wireline conveyance assembly; and a communications module coupled to the head assembly and configured to cause transmission of the measured velocity to a surface system at the well surface via the head assembly and the wireline conveyance assembly.

26. The apparatus of claim 24 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

27. The apparatus of claim 24 wherein the intervention accessory is configured to interface with an object in the wellbore selected from the group consisting of: a plug; a packer; a valve; and a sliding sleeve.

28. An apparatus, comprising:

an anchor assembly configured to anchor the apparatus at a position within a wellbore;

an intervention accessory selected from the group consisting of:

a linear-actuated intervention accessory; and a rotary-actuated intervention accessory;

an actuator configured to cause linear or rotary motion of the intervention accessory relative to the anchor assembly and the anchored position of the apparatus within the wellbore;

a sensor configured to measure, during the motion of the intervention accessory caused by the actuator, a displacement of the intervention accessory caused by the motion; and a drive electronics module configured to:

control the actuator to cause the motion; and adjust control of the actuator during the motion based on the measured displacement.

29. The apparatus of claim 28 further comprising:

a head assembly coupled between the drive electronics module and a wireline conveyance assembly; and a communications module coupled to the head assembly and configured to cause transmission of the measured displacement to a surface system at the well surface via the head assembly and the wireline conveyance assembly.

30. The apparatus of claim 28 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

31. The apparatus of claim 28 wherein the intervention accessory is configured to interface with an object in the wellbore selected from the group consisting of: a plug; a packer; a valve; and a sliding sleeve.

32. An apparatus, comprising:

an anchor assembly configured to anchor the apparatus at a position within a wellbore;

an intervention accessory selected from the group consisting of:

a linear-actuated intervention accessory; and a rotary-actuated intervention accessory;

an actuator configured to cause linear or rotary motion of the intervention accessory relative to the anchor assembly and the anchored position of the apparatus within the wellbore;

a sensor configured to measure, during the motion of the intervention accessory caused by the actuator, a temperature of the actuator; and a drive electronics module configured to:

control the actuator to cause the motion; and adjust control of the actuator during the motion based on the measured temperature.

33. The apparatus of claim 32 further comprising:

a head assembly coupled between the drive electronics module and a wireline conveyance assembly; and a communications module coupled to the head assembly and configured to cause transmission of the measured temperature to a surface system at the well surface via the head assembly and the wireline conveyance assembly.

34. The apparatus of claim 32 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

35. The apparatus of claim 32 wherein the intervention accessory is configured to interface with an object in the wellbore selected from the group consisting of: a plug; a packer; a valve; and a sliding sleeve.

36. An apparatus, comprising:

an anchor assembly configured to anchor the apparatus at a position within a wellbore;

an intervention accessory selected from the group consisting of:

a linear-actuated intervention accessory; and a rotary-actuated intervention accessory;

an actuator configured to cause linear or rotary motion of the intervention accessory relative to the anchor assembly and the anchored position of the apparatus within the wellbore;

a sensor configured to measure, during the motion of the intervention accessory caused by the actuator, a vibration produced by operation of the actuator; and a drive electronics module configured to:

control the actuator to cause the motion; and adjust control of the actuator during the motion based on the measured vibration.

37. The apparatus of claim 36 further comprising:

a head assembly coupled between the drive electronics module and a wireline conveyance assembly; and a communications module coupled to the head assembly and configured to cause transmission of the measured vibration to a surface system at the well surface via the head assembly and the wireline conveyance assembly.

38. The apparatus of claim 36 wherein the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper.

39. The apparatus of claim 36 wherein the intervention accessory is configured to interface with an object in the wellbore selected from the group consisting of: a plug; a packer; a valve; and a sliding sleeve.

40. An apparatus, comprising:

an anchor assembly configured to anchor the apparatus at a position within a wellbore, wherein the anchor assembly comprises a piston connected to arms operable to engage a wall of the wellbore;

an intervention accessory selected from the group consisting of:

a linear-actuated intervention accessory; and a rotary-actuated intervention accessory;

an actuator configured to cause linear or rotary motion of the intervention accessory relative to the anchor assembly and the anchored position of the apparatus within the wellbore;

a drive electronics module control the actuator to cause the motion of the intervention accessory;

a plurality of sensors configured to measure, during the motion of the intervention accessory caused by the actuator, a plurality of parameters associated with the operation or motion of the actuator or the intervention accessory;

a head assembly coupled between the drive electronics module and a wireline conveyance assembly; and a downhole hydraulic power module comprising a motor and a pump and configured to power one or more components of the apparatus;

wherein:

the head assembly comprises a first one of the plurality of sensors configured to measure an amount of tension in the wireline conveyance assembly;

the drive electronics module comprises a second one of the plurality of sensors configured to measure a temperature of electronics contained in the drive electronics module;

the downhole hydraulic power module comprises a third one of the plurality of sensors configured to measure an amount of pressure generated by the downhole hydraulic power module;

the downhole hydraulic power module comprises a fourth one of the plurality of sensors configured to measure a temperature of one or more components of the downhole hydraulic power module;

the anchor assembly comprises a fifth one of the plurality of sensors configured to measure at least one of a linear displacement of the piston, a radial displacement of the arms, an amount of pressure exerted by the arms against the wall of the wellbore, and an amount of slippage of the apparatus relative to the anchored position within the wellbore; and a sixth one of the plurality of sensors is configured to measure at least one of an amount of force exerted by the actuator, an amount of torque exerted by the actuator, a velocity of the motion, a translation of the intervention accessory relative to the apparatus, a temperature of the actuator, and an amount of vibration produced by operation of the actuator; and wherein the drive electronics module is further configured to adjust the control of the actuator based on measurements from a plurality of the first, second, third, fourth, fifth, and sixth ones of the plurality of sensors.

41. The apparatus of claim 40 wherein the drive electronics module is further configured to automatically terminate operation of electronics contained in the drive electronics module when the temperature measured by the second one of the plurality of sensors exceeds a predetermined maximum operating temperature.

42. The apparatus of claim 40 wherein the drive electronics module is further configured to control the downhole hydraulic power module based on the pressure measured by the third one of the plurality of sensors to maintain a desired output pressure.

43. The apparatus of claim 40 wherein the drive electronics module is further configured to automatically terminate operation of the downhole hydraulic power module when the temperature measured by the fourth one of the plurality of sensors exceeds a predetermined maximum operating temperature.

44. The apparatus of claim 40 wherein the intervention accessory comprises one selected from the group consisting of:

a shifting tool;
a debris remover;
a debris collector;
a milling head;
a drilling head;
a hone;
a fishing head;
a welding tool;
a forming tool;
a fluid injection system;
a cutter;
a cleaner;
a polisher;
a caliper; and means for interfacing with an object in the wellbore, wherein the object is selected from the group consisting of:

a plug;
a packer;
a valve; and
a sliding sleeve.

45. A method, comprising:

positioning an apparatus, via a wireline conveyance assembly, within a previously drilled and completed section of a wellbore, wherein the apparatus comprises:

at least one intervention module;

a drive electronics module in communication with the intervention module and configured to control the intervention module; and one or more sensors in communication with the drive electronics module;

anchoring the apparatus at a position in the wellbore by operating an anchor assembly;

initiating an intervention operation by transmitting a signal from the surface to the drive electronics module via at least the wireline conveyance assembly, wherein the intervention operation comprises operating an actuator to cause motion of an intervention accessory relative to the anchor assembly;

measuring, during the intervention operation, one or more parameters associated with the performance of the intervention operation; and adjusting the intervention operation based on the measured one or more parameters.

46. The method of claim 45 wherein measuring comprises measuring an amount of tension in the wireline conveyance assembly, and wherein adjusting the intervention operation is at least partially based on the measured amount of tension.

47. The method of claim 45 wherein measuring comprises measuring a temperature of electronics contained in the drive electronics module, and wherein adjusting the intervention operation is at least partially based on the measured temperature.

48. The method of claim 45 wherein the apparatus further comprises a downhole hydraulic power module configured to power one or more components of the apparatus, wherein measuring comprises measuring an amount of pressure generated by the downhole hydraulic power module, and wherein adjusting the intervention operation is at least partially based on the measured pressure to maintain a desired output pressure of the downhole hydraulic power module.

49. The method of claim 45 wherein the apparatus further comprises a downhole hydraulic power module configured to power one or more components of the apparatus, wherein measuring comprises measuring a temperature of one or more components of the downhole hydraulic power module, and wherein adjusting the intervention operation is at least partially based on the measured temperature.

50. The method of claim 45 wherein the anchor assembly comprises a piston connected to arms operable to engage a wall of the wellbore, wherein measuring comprises measuring a linear displacement of the piston, and wherein adjusting the intervention operation is at least partially based on the measured linear displacement.

51. The method of claim 45 wherein the anchor assembly comprises a piston connected to arms operable to engage a wall of the wellbore, wherein measuring comprises measuring a radial displacement of the arms, and wherein adjusting the intervention operation is at least partially based on the measured radial displacement.

52. The method of claim 45 wherein the anchor assembly comprises a piston connected to arms operable to engage a wall of the wellbore, wherein measuring comprises measuring an amount of pressure exerted by the arms against the wall of the wellbore, and wherein adjusting the intervention operation is at least partially based on the measured pressure.

53. The method of claim 45 wherein the anchor assembly comprises a piston connected to arms operable to engage a wall of the wellbore, wherein measuring comprises measuring an amount of slippage of the apparatus relative to the anchored position within the wellbore, and wherein adjusting the intervention operation is at least partially based on the measured slippage.

54. The method of claim 45 wherein measuring comprises measuring an amount of force exerted by the actuator, and wherein adjusting the intervention operation is at least partially based on the measured force.

55. The method of claim 45 wherein measuring comprises measuring an amount of torque exerted by the actuator, and wherein adjusting the intervention operation is at least partially based on the measured torque.

56. The method of claim 45 wherein measuring comprises measuring a velocity of the motion, and wherein adjusting the intervention operation is at least partially based on the measured velocity.

57. The method of claim 45 wherein measuring comprises measuring a travel of the motion, and wherein adjusting the intervention operation is at least partially based on the measured travel.

58. The method of claim 45 wherein measuring comprises measuring a temperature of the actuator, and wherein adjusting the intervention operation is at least partially based on the measured temperature.

59. The method of claim 45 wherein measuring comprises measuring a vibration produced by operation of the actuator, and wherein adjusting the intervention operation is at least partially based on the measured vibration.

60. The method of claim 45 wherein:

the intervention accessory is selected from the group consisting of: a shifting tool; a debris remover; a debris collector; a milling head; a drilling head; a hone; a fishing head; a welding tool; a forming tool; a fluid injection system; a cutter; a cleaner; a polisher; and a caliper; and initiating the intervention operation comprises initiating a corresponding one selected from the group consisting of: moving a shifting tool; removing debris; collecting debris; milling; drilling; honing; fishing; welding; forming; injecting fluid; cutting; cleaning; polishing; and measuring.

61. The method of claim 45 wherein:

the intervention accessory is configured to interface with an object in the wellbore selected from the group consisting of: a plug; a packer; a valve; and a sliding sleeve; and the intervention operation further comprises interfacing the intervention accessory with the object in the wellbore.

* * * * *